US007348059B2

(12) United States Patent
Zhu et al.

(10) Patent No.: US 7,348,059 B2
(45) **Date of Patent: *Mar. 25, 2008**

(54) MODACRYLIC/ARAMID FIBER BLENDS FOR ARC AND FLAME PROTECTION AND REDUCED SHRINKAGE

(75) Inventors: Reiyao Zhu, Moseley, VA (US); Debbie Guckert, Chester, VA (US); Susan L. Lovasic, Chester, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 262 days.

This patent is subject to a terminal disclaimer.

(21) Appl. No.: 11/189,909

(22) Filed: Jul. 26, 2005

(65) Prior Publication Data

US 2005/0287364 A1 Dec. 29, 2005

Related U.S. Application Data

(63) Continuation-in-part of application No. 10/803,383, filed on Mar. 18, 2004, now Pat. No. 7,065,950.

(51) Int. Cl.
*B32B 27/34* (2006.01)

(52) U.S. Cl. ..... 428/395; 57/252; 428/357; 428/359; 428/364; 428/392

(58) Field of Classification Search ..... 57/252, 57/253.254, 255, 256, 257; 428/357, 359, 428/364, 392, 395, 920
See application file for complete search history.

(56) References Cited

U.S. PATENT DOCUMENTS

| | | | | |
|---|---|---|---|---|
| 3,094,511 | A | 6/1963 | Hill, Jr. et al. | |
| 3,193,602 | A | 7/1965 | Leonard et al. | |
| 3,354,127 | A | 11/1967 | Hill, Jr. et al. | |
| 3,673,143 | A | 6/1972 | Bair et al. | |
| 3,748,302 | A | 7/1973 | Jones | |
| 3,819,587 | A | 6/1974 | Kwoleck | |
| 3,869,429 | A | 3/1975 | Blades | |
| 4,172,938 | A | 10/1979 | Mera et al. | |
| 4,918,912 | A | 4/1990 | Warner | |
| 5,208,105 | A | 5/1993 | Ichibori et al. | |
| 5,223,334 | A | 6/1993 | Green | |
| 5,348,796 | A | 9/1994 | Ichibori et al. | |
| 5,506,042 | A | 4/1996 | Ichibori et al. | |
| 5,727,401 | A * | 3/1998 | Statham | 66/176 |
| 6,743,498 | B2 * | 6/2004 | Fourmeux | 428/131 |
| 6,787,228 | B2 * | 9/2004 | Campbell et al. | 428/365 |
| 6,800,367 | B2 | 10/2004 | Hanyon et al. | |
| 6,823,548 | B2 * | 11/2004 | Murphy et al. | 5/698 |
| 7,065,950 | B2 * | 6/2006 | Zhu et al. | 57/255 |
| 2003/0056297 | A1 * | 3/2003 | Sun | 8/115.51 |
| 2003/0203688 | A1 | 10/2003 | Campbell et al. | |
| 2005/0025963 | A1 | 2/2005 | Zhu | |

FOREIGN PATENT DOCUMENTS

| | | | |
|---|---|---|---|
| EP | 0 940 487 | A | 9/1999 |
| GB | 2 152 542 | A | 8/1985 |
| WO | WO 2005/090661 | A1 | 9/2005 |

OTHER PUBLICATIONS

U.S. Appl. No. 10/803,383, filed Mar. 18, 2004, Zhu et al.
W. Black et al., Man-Made Fibers, Science and Technology, vol. 2, "Fiber Forming Aromatic Polyamides", p. 297, Interscience Publishers, 1968.

* cited by examiner

*Primary Examiner*—Arti Singh

(57) ABSTRACT

A yarn, fabric and garment suitable for use in arc and flame protection contains modacrylic, p-aramid and m-aramid fibers wherein the m-aramid fibers have a degree of crystallinity of at least 20%.

23 Claims, No Drawings

MODACRYLIC/ARAMID FIBER BLENDS FOR ARC AND FLAME PROTECTION AND REDUCED SHRINKAGE

RELATED APPLICATION

The present patent application is a continuation-in-part of Ser. No. 10/803,383 filed Mar. 18, 2004 now U.S. Pat. No. 7,065,950.

BACKGROUND OF THE INVENTION

1. Field of the Invention

This invention relates to a blended yarn useful for the production of fabrics which possess arc and flame protective properties as well as reduced shrinkage. This invention also relates to garments produced with such fabrics.

2. Description of Related Art

Individuals working near energized electrical equipment and emergency personnel who respond to incidents near electrical equipment are at risk from electrical arcs and flame hazards which could result from an arcing event. Electrical arcs are extremely violent events typically involving thousands of volts and thousands of amperes of electricity. Electrical arcs are formed in air when the potential difference (i.e. voltage) between two electrodes causes the atoms in the air to ionize and become able to conduct electricity.

U.S. Pat. No. 5,208,105 to Ichibori et al. discloses a flame retarded composite fiber blend comprising a halogen containing fiber having a large amount of an antimony compound and at least one fiber selected from the list consisting of natural fibers and chemical fibers. The fiber blend is woven into a fabric and tested for Limited Oxygen Index as a measure of its flame resistance.

What is needed is a yarn, fabric and garment which possess a high level of arc and flame protection.

SUMMARY OF THE INVENTION

This invention relates to yarn for use in arc and flame protection fabrics and garments comprising:

(a) 40 to 70 weight percent modacrylic fiber, (b) 5 to 20 weight percent p-aramid fiber and (c) 10 to 40 weight percent m-aramid fiber having a degree of crystallinity of at least 20%, said percentages on the basis of components (a) (b) and (c).

Furthermore the fabric and garment can provide resistance to break open and abrasion. In a preferred mode the fabric and garment have a reduced shrinkage such as compared to a fabric wherein the only change is use of an m-aramid fiber is amorphous (i.e. having a low degree of crystallinity).

DETAILED DESCRIPTION OF THE INVENTION

This invention relates to providing a yarn from with fabrics and garment may be produced that provide both arc protection and flame resistance. Fabrics and garments comprising flame resistant fibers of low tensile strength when exposed to the intense thermal stress of an electrical arc can break open exposing the wearer to additional injury as a result of the incident energy. Electrical arcs typically involve thousands of volts and thousands of amperes of electrical current. The electrical arc is much more intense than incident energy such as from flash fire. To offer protection to a wearer a garment or fabric must resist the transfer to energy through to the wearer. It is believed that this occurs both by the fabric absorbing a portion of the incident energy and by the fabric resisting breakopen. During breakopen a hole forms in the fabric directly exposing the surface or wearer to the incident energy.

Yarns, fabrics and garments of this invention when exposed to the intense thermal stress of an electrical arc resist the transfer of energy. It is believed that this invention reduces energy transfer by absorbing a portion of the incident energy and through charring allows a reduction in transmitted energy.

Yarns of this invention comprise a blend of modacrylic fiber, meta-aramid fiber, and para-aramid fiber. Typically, yarns of this invention comprise 40 to 70 weight percent modacrylic fiber, 5 to 20 weight percent para-aramid fiber, and 10 to 40 percent meta-aramid fiber with a degree of crystallinity of at least 20%. Preferably, yarns of this invention comprise 55 to 65 weight percent modacrylic fiber, 5 to 15 weight percent para-aramid fiber, and 20 to 30 percent meta-aramid fiber. The above percentages are on a basis of the three named components. Additionally an additional abrasion resistant fiber may be added to the yarn to improve durability via improved abrasion resistance. As well as the antistatic fiber to reduce the static build-ups.

By "yarn" is meant an assemblage of fibers spun or twisted together to form a continuous strand, which can be used in weaving, knitting, braiding, or plaiting, or otherwise made into a textile material or fabric.

By modacrylic fiber it is meant acrylic synthetic fiber made from a polymer comprising primarily acrylonitrile. Preferably the polymer is a copolymer comprising 30 to 70 weight percent of a acrylonitrile and 70 to 30 weight percent of a halogen-containing vinyl monomer. The halogen-containing vinyl monomer is at least one monomer selected, for example, from vinyl chloride, vinylidene chloride, vinyl bromide, vinylidene bromide, etc. Examples of copolymerizable vinyl monomers are acrylic acid, methacrylic acid, salts or esters of such acids, acrylamide, methylacrylamide, vinyl acetate, etc.

The preferred modacrylic fibers of this invention are copolymers of acrylonitrile combined with vinylidene chloride, the copolymer having in addition an antimony oxide or antimony oxides for improved fire retardancy. Such useful modacrylic fibers include, but are not limited to, fibers disclosed in U.S. Pat. No. 3,193,602 having 2 weight percent antimony trioxide, fibers disclosed in U.S. Pat. No. 3,748,302 made with various antimony oxides that are present in an amount of at least 2 weight percent and preferably not greater than 8 weight percent, and fibers disclosed in U.S. Pat. Nos. 5,208,105 & 5,506,042 having 8 to 40 weight percent of an antimony compound.

Within the yarns of this invention modacrylic fiber provides a flame resistant char forming fiber with an LOI typically at least 28 depending on the level of doping with antimony derivatives. Modacrylic fiber is also resistant to the spread of damage to the fiber due to exposure to flame. Modacrylic fiber while highly flame resistant does not by itself provide adequate tensile strength to a yarn or fabric made from the yarn to offer the desired level of breakopen resistance when exposed to an electrical arc.

As used herein, "aramid" is meant a polyamide wherein at least 85% of the amide (—CONH—) linkages are attached directly to two aromatic rings. Additives can be used with the aramid and, in fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. Suitable aramid fibers are described in Man-Made Fibers--Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3, 354,127; and 3,094,511. M-aramid are those aramids where the amide linkages are in the meta-position relative to each other, and p-aramids are those aramids where the amide linkages are in the para-position relative to each other. In the practice of this invention the aramids most often used are poly(paraphenylene terephthalamide) and poly(metaphenylene isophthalamide).

Within yarns of this invention m-aramid fiber may provide a flame resistant char forming fiber with an LOI of about 26. M-aramid fiber is also resistant to the spread of damage to the fiber due to exposure to flame. M-aramid fiber also adds comfort to fabrics formed of fibers comprising yarn of this invention.

M-aramid fiber provides additional tensile strength to the yarn and fabrics formed from the yarn. Modacrylic and m-aramid fiber combinations are highly flame resistant but do not provide adequate tensile strength to a yarn or fabric made from the yarn to offer the desired level of breakopen resistance when exposed to an electrical arc.

The present invention is within the scope of parent application Ser. No.10/803,383. However, criticality is present in the type of m-aramid fiber which is employed. It has been unexpectedly discovered that if the m-aramid fiber has a certain minimum degree of crystallinity that a further improvement in arc protection is obtained.

The degree of crystallinity of the m-aramid fiber is at least 20% and more preferably at least 25%. For purposes of illustration due to ease of formation of the final fiber a practical upper limit of crystallinity is 50% (although higher percentages are considered suitable). Generally, the crystallinity will be in a range from 25 to 40%. An example of a commercial m-aramid fiber having this degree of crystallinity is Nomex® T450.

The degree of crystallinity of an m-aramid fiber is determined by one of two methods. The first method is employed with a non-voided fiber while the second is on a fiber which is not totally free of voids.

The percent crystallinity of meta-aramids in the first method is determined by first generating a linear calibration curve for crystallinity using good, essentially non-voided samples. For such non-voided samples the specific volume (1/density) can be directly related to crystallinity using a two-phase model. The density of the sample is measured in a density gradient column. A meta-aramid film, determined to be non-crystalline by x-ray scattering methods, was measured and found to have an average density of 1.3356 g/cm3. The density of a completely crystalline meta-aramid sample was then determined from the dimensions of the x-ray unit cell to be 1.4699 g/cm3. Once these 0% and 100% crystallinity end points are established, the crystallinity of any non-voided experimental sample for which the density is known can be determined from this linear relationship:

$$\text{Crystallinity} = \frac{(1/\text{non-crystalline density}) - (1/\text{experimental density})}{(1/\text{non-crystalline density}) - (1/\text{fully-crystalline density})}$$

Since many fiber samples are not totally free of voids, Raman spectroscopy is the preferred method to determine crystallinity. Since the Raman measurement is not sensitive to void content, the relative intensity of the carbonyl stretch at 1650-1 cm can be used to determine the crystallinity of a meta-aramid in any form, whether voided or not. To accomplish this, a linear relationship between crystallinity and the intensity of the carbonyl stretch at 1650 cm-1, normalized to the intensity of the ring stretching mode at 1002 cm-1, was developed using minimally voided samples whose crystallinity was previously determined and known from density measurements as described above. The following empirical relationship, which is dependent on the density calibration curve, was developed for percent crystallinity using a Nicolet Model 910 FT-Raman Spectrometer:

$$\%\ \text{crystallinity} = 100.0 \times \frac{(I(1650\ \text{cm-}1) - 0.2601)}{0.1247}$$

where 1(1650 cm-1) is the Raman intensity of the meta-aramid sample at that point. Using this intensity the percent crystallinity of the experiment sample is calculated from the equation.

Meta-aramid fibers, when spun from solution, quenched, and dried using temperatures below the glass transition temperature, without additional heat or chemical treatment, develop only minor levels of crystallinity. Such fibers have a percent crystallinity of less than 15 percent when the crystallinity of the fiber is measured using Raman scattering techniques. These fibers with a low degree of crystallinity are considered amorphous meta-aramid fibers which can be crystallized through the use of heat or chemical means. The level of crystallinity can be increased by heat treatment at or above the glass transition temperature of the polymer. Such heat is typically applied by contacting the fiber with heated rolls under tension for a time sufficient to impart the desired amount of crystallinity to the fiber.

Within yarns of this invention p-aramid fibers provide a high tensile strength fiber which when added in adequate amounts improves the breakopen resistance of fabrics formed from the yarn. Large amounts of p-aramid fibers in the yarns make garments comprising the yarns uncomfortable to the wearer.

The term tensile strength refers to the maximum amount of stress that can be applied to a material before rupture or failure. The tear strength is the amount of force required to tear a fabric. In general the tensile strength of a fabric relates to how easily the fabric will tear or rip. The tensile strength may also relate to the ability of the fabric to avoid becoming permanently stretched or deformed. The tensile and tear strengths of a fabric should be high enough so as to prevent ripping, tearing, or permanent deformation of the garment in a manner that would significantly compromise the intended level of protection of the garment.

Additionally an abrasion resistant fiber may be added to the yarn to improve durability via improved abrasion resistance. By abrasion resistant it is meant the ability of a fiber or fabric to withstand surface wear and rubbing. Preferably the abrasion resistant fiber is a nylon. By nylon it is meant fibers made from aliphatic polyamide polymers; and polyhexamethylene adipamide (nylon 66) is the preferred nylon polymer. Other nylons such as polycaprolactam (nylon 6), polybutyrolactam (nylon 4), poly(9-aminononanoic acid) (nylon 9), polyenantholactam (nylon 7), polycapryllactam (nylon 8), polyhexamethylene sebacamide (nylon 6, 10), and the like are suitable.

The abrasion resistant fiber typically comprises 2 to 15 weight percent of the yarn. Yarns containing less than 2 weight percent of abrasion resistant fiber do not show a marked improvement in abrasion resistance. Yarns containing abrasion resistant fibers in excess of 15 weight percent may experience a reduction in the flame resistance and arc protective properties of the yarn and fabrics formed from the yarn.

Additionally, to the yarn, fabric, or garment of this invention may be added an antistatic component. Illustrative examples are steel fiber, carbon fiber, or a carbon coating to an existing fiber. The conductivity of carbon or a metal such as steel when incorporated in a yarn, fabric, or garment of this invention provides an electrical conduit to assist in dissipating the buildup of static electricity. Static electrical discharges can be hazardous for workers working with sensitive electrical equipment or near flammable vapors. The antistatic component may be present in an amount of 1 to 5 weight percent of the total yarn.

Yarns of this invention may be produced by any of the yarn spinning techniques commonly known in the art such as but not limited to ring spinning, core spinning, and air jet spinning or higher air spinning techniques such as Murata air jet spinning where air is used to twist staple fibers into a yarn provided the required degree of crystallinity is present in the final yarn. Typically the single yarns produced by any of the common techniques are then plied together to form a ply-twisted yarn comprising at least two single yarns prior to being converted into a fabric.

To provide protection from the intense thermal stresses caused by electrical arcs it is desirable that an arc protective fabric and garments formed from that fabric possess features such as an LOI above the concentration of oxygen in air for flame resistance, a short char length indicative of slow propagation of damage to the fabric, and good breakopen resistance to prevent incident energy from directly impinging on the surfaces below the protective layer.

Thermally protective garments such as firefighter turnout gear typically provide protection against the convective heat generated by an open flame. Such protective garments when exposed to the intense energy generated by an electrical arc can breakopen (i.e. an opening form in the fabric) resulting in the energy penetrating the garment and causing severe injury to the wearer. Fabrics of this invention preferably provide both protection against the convective heat of an open flame and offer increased resistance to breakopen and energy transfer when exposed to an electrical arc.

The term fabric, as used in the specification and appended claims, refers to a desired protective layer that has been woven, knitted, or otherwise assembled using one or more different types of the yarn of this invention. Preferably fabrics of this invention are woven fabrics. Most preferably the fabrics of this invention are a twill weave.

In a preferred embodiment of the present invention, it has been further discovered that the use of crystalline m-aramid fiber as previously described results in significantly reduced shrinkage or even 0% shrinkage. This reduced shrinkage is based on an identical fabric wherein the only difference is use of m-aramid fiber having the degree of crystallinity set forth previously compared to an m-aramid fiber which has not been treated to increase crystallinity.

For purposes herein shrinkage is measured after a wash cycle of 20 minutes with a water temperature of 140° F. Preferred fabrics demonstrate non-shrinkage after 5 wash cycles, more preferably 10 cycles and most preferably 20 cycles.

Basis weight is a measure of the weight of a fabric per unit area. Typical units include ounces per square yard and grams per square centimeter. The basis weights reported in this specification are reported in ounces per square yard (OPSY). As the amount of fabric per unit area increases the amount of material between a potential hazard and the subject to be protected increases. An increase in the basis weight of a material suggests that a corresponding increase in protective performance will be observed. An increase in basis weight of fabrics of this invention results in increased breakopen resistance, increased thermal protection factor, and increased arc protection. Basis weights of fabrics of this invention are typically greater than about 8.0 opsy, preferably greater than about 8.7 opsy, and most preferably greater than about 9.5 opsy. It is believed fabrics of this invention with basis weights greater than about 12 opsy would show increased stiffness and would thereby reduce the comfort of a garment produced from such fabric.

Char length is a measure of the flame resistance of a textile. A char is defined as a carbonaceous residue formed as the result of pyrolysis or incomplete combustion. The char length of a fabric under the conditions of test of ASTM 6413-99 as reported in this specification is defined as the distance from the fabric edge, which is directly exposed to the flame to the furthest point of visible fabric damage after a specified tearing force has been applied. Preferably fabric of this invention have a char length of less than 6 inches.

Fabrics of this invention may be used as a single layer or as part of a multi-layer protective garment. Within this specification the protective value of a fabric is reported for a single layer of that fabric. This invention also includes a garment made from the fabrics of this invention.

The yarns of this invention may be present in either the warp or fill of the fabric. Preferably the yarns of this invention are present in both the warp and fill of the resulting fabric. Most preferably the yarns of this invention are exclusively present in both the warp and fill of the fabric.

TEST METHODS

Abrasion Test

The abrasion performance of fabrics of this invention is determined in accordance with ASTM D-3884-01 "Standard Guide for Abrasion Resistance of Textile Fabrics (Rotary Platform, Double Head Method)".

Arc Resistance Test

The arc resistance of fabrics of this invention is determined in accordance with ASTM F-1 959-99 "Standard Test Method for Determining the Arc Thermal Performance Value of Materials for Clothing". Preferably fabrics of this invention have an arc resistance of at least 0.8 calories and more preferably at least 1.2 calories per square centimeter per opsy.

Grab Test

The grab resistance of fabrics of this invention is determined in accordance with ASTM D-5034-95 "Standard Test Method for Breaking Strength and Elongation of Fabrics (Grab Test)".

Limited Oxygen Index Test

The limited oxygen index (LOI) of fabrics of this invention is determined in accordance with ASTM G-125-00 "Standard Test Method for Measuring Liquid and Solid Material Fire Limits in Gaseous Oxidants".

Tear Test

The tear resistance of fabrics of this invention is determined in accordance with ASTM D-5587-03 "Standard Test Method for Tearing of Fabrics by Trapezoid Procedure".

Thermal Protection Performance Test

The thermal protection performance of fabrics of this invention is determined in accordance with NFPA 2112 "Standard on Flame Resistant Garments for Protection of Industrial Personnel Against Flash Fire".

Vertical Flame Test

The char length of fabrics of this invention is determined in accordance with ASTM D-6413-99 "Standard Test Method for Flame Resistance of Textiles (Vertical Method)".

The term thermal protective performance (or TPP) relates to a fabric's ability to provide continuous and reliable protection to a wearer's skin beneath a fabric when the fabric is exposed to a direct flame or radiant heat.

LOI

From ASTM G125/D2863

The minimum concentration of oxygen, expressed as a volume percent, in a mixture of oxygen and nitrogen that will just support flaming combustion of a material initially at room temperature under the conditions of ASTM D2863.

Shrinkage Determination

Shrinkage is determined by physically measuring unit area of a fabric after one or more wash cycles. A cycle denotes washing the fabric in an industrial washing machine for 20 minutes with a water temperature of 140 degrees F.

To illustrate the present invention, the following examples are provided. All parts and percentages are by weight and degrees in Celsius unless otherwise indicated.

EXAMPLES

Example 1

A thermal protective and durable fabric was prepared having in the both warp and fill of ring spun yarns of intimate blends of Nomex® type 450, Kevlar® 29, Modacrylic and nylon. Nomex® type 450 is poly(m-phenylene isophthalamide)(MPD-I) with a degree of crystallinity of 33-37%, Modacrylic is ACN/polyvinylidene chloride co-polymer with 6.8% antimony (known as Protex®C), Kevlar® 29 is poly(p-phenylene terephthalamide)(PPD-T).

A picker blend sliver of 25 wt. % of Nomex® type 450, 10 wt. % of Kevlar® 29, and 65 wt. % of Modacrylic was prepared and processed by the conventional cotton system into a spun yarn having twist multiply 3.7 using a ring spinning frame. The yarn so made was 21tex (28 cotton count) single yarn. Two single yarns are then plied on the plying machine to make a two-ply yarn. Using similar process and same twist and blend ratio, a 21tex(28 cotton count) yarn was made for using as fill yarn. The yarns were then two-plied to form a ply yarn.

The Nomex®/Kevlar®/Modacrylic yarns were used as the warp and fill in a shuttle loom in a 3×1 twill construction. The greige twill fabric had a construction of 30 ends×19 picks per cm (76 ends×47 picks per inch), and basis weight of 189 g/m^2 (6.5 oz/yd^2). The greige twill fabric prepared as described above was scoured in hot water and dried under low tension. The scoured fabric was then jet dyed using basic dye. The finished fabric 198 g/m^2 (6.8 oz/yd^2) was then tested for thermal and mechanical properties.

Example 2 (Control)

A thermal protective and durable fabric was prepared having in the both warp and fill of ring spun yarns of intimate blends of Nomex® type 455, Kevlar® 29, Modacrylic and nylon. Nomex® type 455 is poly(m-phenylene isophthalamide)(MPD-I) with a degree of crystallinity of 5-10%, Modacrylic is ACN/polyvinylidene chloride co-polymer with 6.8% antimony (known as Protex®C), Kevlar® 29 is poly(p-phenylene terephthalamide)(PPD-T), P140 is the antistatic fiber.

A picker blend sliver of 23 wt. % of Nomex® type 455, 10 wt. % of Kevlar® 29, 65 wt. % of Modacrylic and 2% P140was prepared and processed by the conventional cotton system into a spun yarn having twist multiply 3.7 using a ring spinning frame. The yarn so made was 21tex (28 cotton count) single yarn. Two single yarns are then plied on the plying machine to make a two-ply yarn. Using similar process and same twist and blend ratio, a 21tex(28 cotton count) yarn was made for using as fill yarn. The yarns were then two-plied to form a ply yarn.

The Nomex®/Kevlar®/Modacrylic yarns were used as the warp and fill in a shuttle loom in a 3×1 twill construction. The greige twill fabric had a construction of 31 ends×22 picks per cm (78 ends×56 picks per inch), and basis weight of 209 g/m^2 (7.2 oz/yd^2). The greige twill fabric prepared as described above was scoured in hot water and dried under low tension. The scoured fabric was then jet dyed using basic dye. The finished fabric 233 g/m^2 (8.0 oz/yd^2) was then tested by its thermal and mechanical properties.

Additionally fabrics of Examples 1 and 2 were tested for shrinkage at various wash cycles with each cycle being 20 minutes with a water temperature of 140 degrees F. and drying temperature 140 F

| | Example 1 | Example 2 |
|---|---|---|
| Basis Weight (opsy) | 6.8 | 8.0 |
| Thickness (mil) | 34 | 37 |
| Antimony content (%) In modacrylic fiber | 7 | 7 |
| Vertical Flame (in) W/F | 3.1 × 3.0 | 3.0 × 3.0 |
| ARC rating (cal/cm2) | 9.6 | 9.6 |
| ARC/unit weight (opsy) | 1.4 | 1.2 |
| Laundry Shrinkage (% warpfill) | | |
| 3 | 0 × 0 | 1.0 × 1.0 |
| 5 | 0 × 0 | 2.0 × 2.0 |
| 10 | 0 × 0 | 4.0 × 3.0 |

Examples 1 and 2 by replacing Nomex 462 (example 2) with Nomex 450(example 1), an improvement of arc/unit weight of 16% was obtained. Also the fabric of Example 1 had no shrinkage while the Example 2 fabric increased in shrinkage with added wash cycles.

Example 3

A thermal protective and durable fabric was prepared having in the both warp and fill of ring spun yarns of intimate blends of 20%Nomex® type N303, 10% Kevlar® 29, 60% Modacrylic and 10% nylon. Nomex® type N303 is 92% of poly(m-phenylene isophthalamide)(MPD-I) with a degree of crystallinity of 33-37%, 5% Kevlar® 29 and 3% P140 (nylon coated with carbon for antistatic), Modacrylic is ACN/polyvinylidene chloride co-polymer with 2% antimony, Kevlar® 29 is poly(p-phenylene terephthalamide) (PPD-T) and the nylon used was polyhexamethylene adipamide.

| | Example 3 |
|---|---|
| Basis Weight (opsy) | 9.6 |
| Thickness (mil) | 40 |
| Grab Test Break Strength (lbf) Warp/Fill D5034-95 | 205/164 |
| Trap Tear (lbf) Warp/Fill D5587-03 | 28/21 |
| Taber Abrasion (Cycles)CS-10/1000 g ASTM D3884-01 | 3143 |
| TPP (cal/cm2) NFPA 2112 | 16.3 |
| Vertical Flame (inches) Warp/Fill ASTM D6413-99 | 2.9/3.0 |
| ARC Rating (cal/cm2) ASTM F1959-99 | 17.6 |

What is claimed is:

1. A yarn for use in arc and flame protection comprising:
(a) 40 to 70 weight percent modacrylic fiber,
(b) 5 to 20 weight percent p-aramid fiber and
(c) 10 to 40 weight percent m-aramid fiber having a degree of crystallinity of at least 20%,
said percentages on the basis of components (a) (b) and (c).

2. The yarn of claim 1 comprising:
(a) 55 to 65 weight percent modacrylic fiber
(b) 5 to 15 weight percent p-aramid fiber and
(c) 20 to 35 weight percent m-aramid fiber.

3. The yarn of claim 1 which additionally contains (d) an abrasion resistant fiber.

4. The yarn of claim 3 wherein the abrasion resistant fiber is present in an amount of 2 to 15 weight percent on the basis of components (a), (b), (c) and (d).

5. The yarn of claim 3 wherein the abrasion resistant fiber is nylon.

6. The yarn of claim 1 which additionally contains an anti-static component.

7. The yarn of claim 6 wherein the anti-static component is present in an amount of 1 to 5 weight percent of the total yarn.

8. The yarn of claim 6 wherein the anti-static component comprises carbon or metal fiber.

9. The yarn of claim 8 wherein the anti-static component comprises carbon.

10. The yarn of claim 1 with the m-aramid fiber having a degree of crystallinity in a range from 20 to 50%.

11. The yarn of claim 1 having a shrinkage of about 0% after 10 wash cycles.

12. A fabric suitable for use in arc and flame protection comprising:
a yarn the yarn further comprising
(a) 40 to 70 weight percent modacrylic fiber,
(b) 5 to 20 weight percent p-aramid fiber and,
(c) 10 to 40 weight percent m-aramid fiber having a degree of crystallinity of at least 20%,
said percentages on the basis of components (a) (b) and (c).

13. The fabric of claim 12 wherein the yarn comprises;
(a) 55 to 65 weight percent modacrylic fiber
(b) 5 to 15 weight percent p-aramid fiber and
(c) 20 to 35 weight percent m-aramid fiber.

14. The fabric of claim 12 which additionally comprises (d) an abrasion resistant fiber.

15. The fabric of claim 14 wherein the abrasion resistant fiber is present in an amount of 2 to 15 weight percent on the basis of components (a), (b), (c) and (d).

16. The fabric of claim 14 wherein the abrasion resistant fiber is nylon.

17. The fabric of claim 12 which additionally contains an anti-static component.

18. The fabric of claim 12 which has a char length according to ASTM D-6413-99 of less than 6 inches.

19. The fabric of claim 12 which has arc resistance according to ASTM F-1959-99 of at least 0.8 calories per square centimeter per opsy.

20. The fabric of claim 19 wherein the arc resistance is at least 1.2 calories per square centimeter per opsy.

21. The fabric of claim 12 wherein the m-aramid fiber having a degree of crystallinity in a range from 20 to 50%.

22. The yarn of claim 1 having a shrinkage of 0% after 10 wash cycles.

23. A garment suitable for use in arc and flame protection:
(a) 40 to 70 weight percent modacrylic fiber,
(b) 5 to 20 weight percent p-aramid fiber and
(c) 10 to 40 weight percent m-aramid fiber having a degree of crystallinity of at least 20%,
said percentages on the basis of components (a) (b) and (c).

* * * * *